US007600970B2

(12) United States Patent
Bhate et al.

(10) Patent No.: US 7,600,970 B2
(45) Date of Patent: Oct. 13, 2009

(54) CERAMIC MATRIX COMPOSITE VANE SEALS

(75) Inventors: Nitin Bhate, Rexford, NY (US); Thomas Allen Wells, West Chester, OH (US); Ian Francis Prentice, Cincinnati, OH (US); John Greene, Greenville, SC (US)

(73) Assignee: General Electric Company, Schenectady, NY (US)

( * ) Notice: Subject to any disclaimer, the term of this patent is extended or adjusted under 35 U.S.C. 154(b) by 262 days.

(21) Appl. No.: 11/164,866

(22) Filed: Dec. 8, 2005

(65) Prior Publication Data

US 2008/0112804 A1 May 15, 2008

(51) Int. Cl.
*F01D 9/02* (2006.01)

(52) U.S. Cl. ..... 415/191; 415/200; 415/211.2; 415/209.4; 415/210.1

(58) Field of Classification Search ..... 415/191, 415/200, 211.2, 209.4, 210.1; 277/627, 651, 277/653, 654
See application file for complete search history.

(56) References Cited

U.S. PATENT DOCUMENTS

| | | | | |
|---|---|---|---|---|
| 5,509,669 | A * | 4/1996 | Wolfe et al. | 277/654 |
| 5,630,700 | A * | 5/1997 | Olsen et al. | 415/134 |
| 6,200,092 | B1 * | 3/2001 | Koschier | 415/191 |
| 6,464,456 | B2 * | 10/2002 | Darolia et al. | 415/134 |
| 6,502,825 | B2 * | 1/2003 | Aksit et al. | 277/355 |
| 6,659,472 | B2 * | 12/2003 | Aksit et al. | 277/647 |
| 7,052,234 | B2 * | 5/2006 | Wells et al. | 415/137 |

* cited by examiner

*Primary Examiner*—Ninh H Nguyen
(74) *Attorney, Agent, or Firm*—Sutherland Asbill & Brennan LLP

(57) ABSTRACT

A ceramic matrix composite nozzle assembly. The ceramic matrix composite nozzle assembly may include a ceramic matrix composite vane, a number of metallic components positioned about the ceramic matrix composite vane, and a number of metallic seals positioned between the ceramic matrix composite vane and one or more of the metallic components.

13 Claims, 4 Drawing Sheets

CERAMIC MATRIX COMPOSITE VANE SEALS

TECHNICAL FIELD

The present application relates generally to gas turbine engines and more particularly relates to seals between ceramic matrix composite vanes and the metallic components of a gas turbine engine.

BACKGROUND OF THE INVENTION

In a gas turbine engine, air is pressurized in a compressor, mixed with fuel in a combustor, and ignited for generating hot combustion gases that flow downstream into a turbine so as to extract energy therefrom. The turbine generally includes a number of turbine nozzles with each of the nozzles having a number of circumferentially spaced apart nozzle vanes supported by integral outer and inner bands.

Overall engine efficiency is related to the temperature of the combustion gases. As a result, ceramic matrix composite ("CMC") materials have been used to form the nozzle vanes because of their high temperature capabilities. Although the CMC vanes may not require cooling, the attachments to the vane, such as the strut and the metallic bands, do require cooling. In order to minimize the parasitic losses and improve the efficiency of the overall turbine engine, the amount of cooling air used to cool the metallic attachments should be minimized. Specifically, effective sealing will minimize the cooling air leakage and thereby improve the efficiency of the turbine engine. Effective sealing design also will prevent the ingestion of hot gas into the metallic attachment section of the turbine and thereby increase the life of the metallic components.

Thus, there is a need for improved sealing methods between a CMC vane and the associated metallic components. The seals preferably will be easy to install, have an adequate lifetime, provide increased efficiency, and substantially prevent the leakage of the cooling air.

SUMMARY OF THE INVENTION

The present application thus provides a ceramic matrix composite nozzle assembly. The ceramic matrix composite nozzle assembly may include a ceramic matrix composite vane, a number of metallic components positioned about the ceramic matrix composite vane, and a number of metallic seals positioned between the ceramic matrix composite vane and one or more of the metallic components.

The metallic seals may include an exterior seal, an interior seal, and/or a horizontal seal. The metallic seals may include a number of shims, a cloth and a crimped metal shim, a shim and a metal cloth sandwich, and/or a metallic foil. The metallic seals may include a compliant material.

The metallic components may include an inner diameter band and an outer diameter band and the metallic seals may be attached to the inner diameter band and the outer diameter band. The metallic components may include a strut casing and the metallic seals may be attached to the strut casing. The ceramic matrix composite nozzle assembly may have a number of ceramic matrix composite vanes.

The present application further describes a ceramic matrix composite nozzle assembly. The ceramic matrix composite nozzle assembly may include a ceramic matrix composite vane, an inner diameter metallic band and an outer diameter metallic band positioned about the ceramic matrix composite vane, and a number of metallic seals positioned between the ceramic matrix composite vane and the inner diameter metallic band and the outer diameter metallic band. The metallic seals may include a cloth and a crimped metal shim, a shim and a metal cloth sandwich, and/or a metallic foil.

The present application further describes a ceramic matrix composite nozzle assembly. The ceramic matrix composite nozzle assembly may include a ceramic matrix composite vane, a strut casing positioned about the ceramic matrix composite vane, and a number of metallic seals positioned between the ceramic matrix composite vane and the strut casing. The metallic seals may include a cloth and crimped metal shim, a shim and a metal cloth sandwich, and/or a metallic foil.

These and many other features of the present application will become apparent to one of ordinary skill in the art upon review of the following detailed description of the invention when taken in conjunction with the drawings and the appended claims.

DETAILED DESCRIPTION

Figure 1:
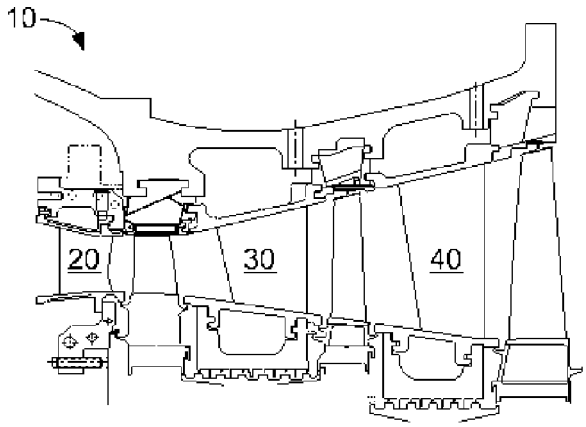
FIG. 1 is a cross-sectional view of a turbine.

Referring now to the drawings, in which like numbers refer to like elements throughout the several views, FIG. 1 shows a turbine 10. As is well known, the turbine 10 includes a number of stages, in this case a first stage 20, a second stage 30, and a third stage 40. Additional stages may be used. Although the present application will focus primarily on the second stage 30, the use of other stages is contemplated herein.

Figure 2:
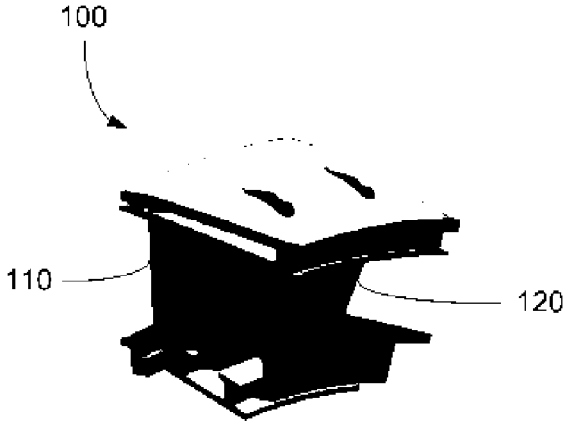
FIG. 2 is a perspective view of a ceramic matrix composite nozzle assembly for use in a stage two nozzle.
Figure 3:
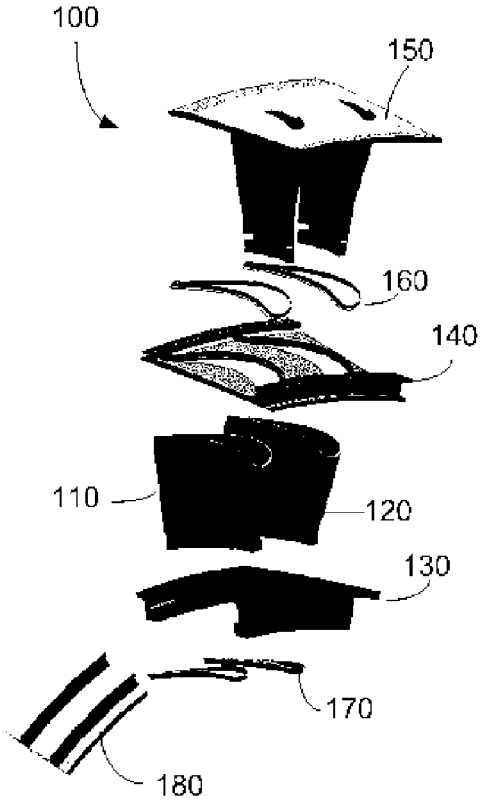
FIG. 3 is an exploded view of the ceramic matrix composite nozzle assembly of FIG. 2.

FIGS. 2 and 3 show a ceramic matrix composite nozzle assembly 100 as is described herein. CMC materials are commercially available and may include silicone carbide fibers in a silicone carbide matrix. The fibers and the matrix are initially contained in a green stage, which is generally pliable until processed or cured into the final ceramic state. The nozzle assembly 100 includes a pair of CMC vanes, a first vane 110 and a second vane 120. The nozzle assembly 100 may be used in the second stage nozzle 30 or elsewhere.

As is known, the vanes 110, 120 may be positioned between a pair of bands, an inner diameter band 130 and an outer diameter band 140. A strut casing 150 is positioned within the vanes 120 from the outer diameter band 140 to the inner diameter band 130. A pair of cloth seals, a first set of cloth seal 160 and a second set of cloth seal 170 may be positioned between the strut casing 150 and the outer diameter band 140 as well as underneath the inner diameter band 130. The inner diameter band 130 of the CMC nozzle assembly 100 is positioned on a diaphragm 180 of the turbine 10.

Figure 4:
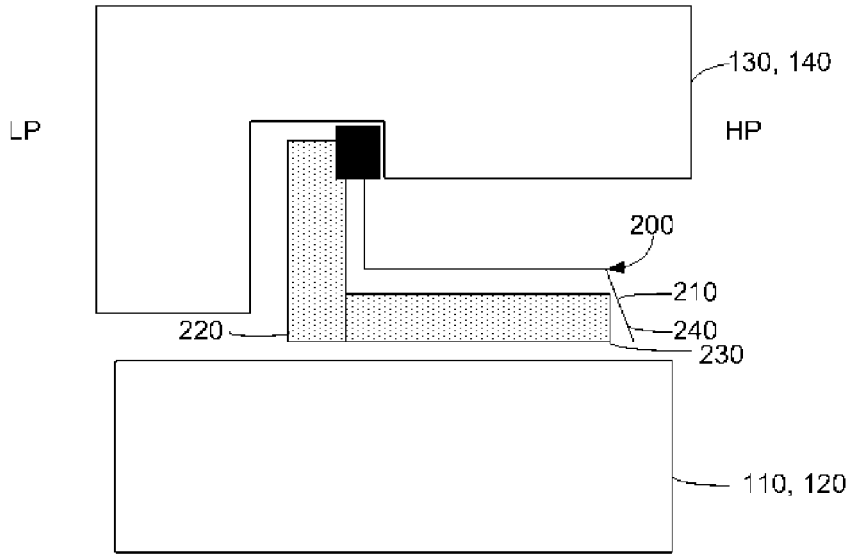
FIG. 4 is a cross-sectional view of an exterior seal as is described herein.
Figure 5:
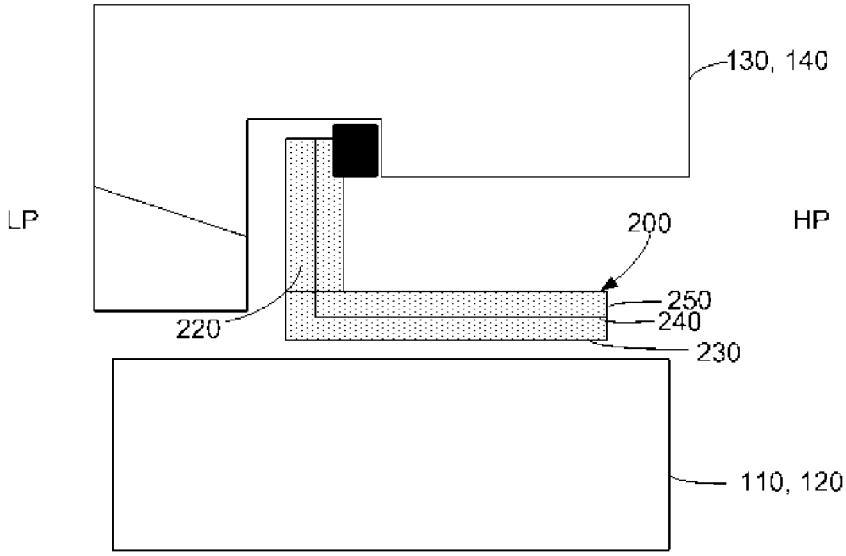
FIG. 5 is an alternative embodiment of the exterior seal.
Figure 6:
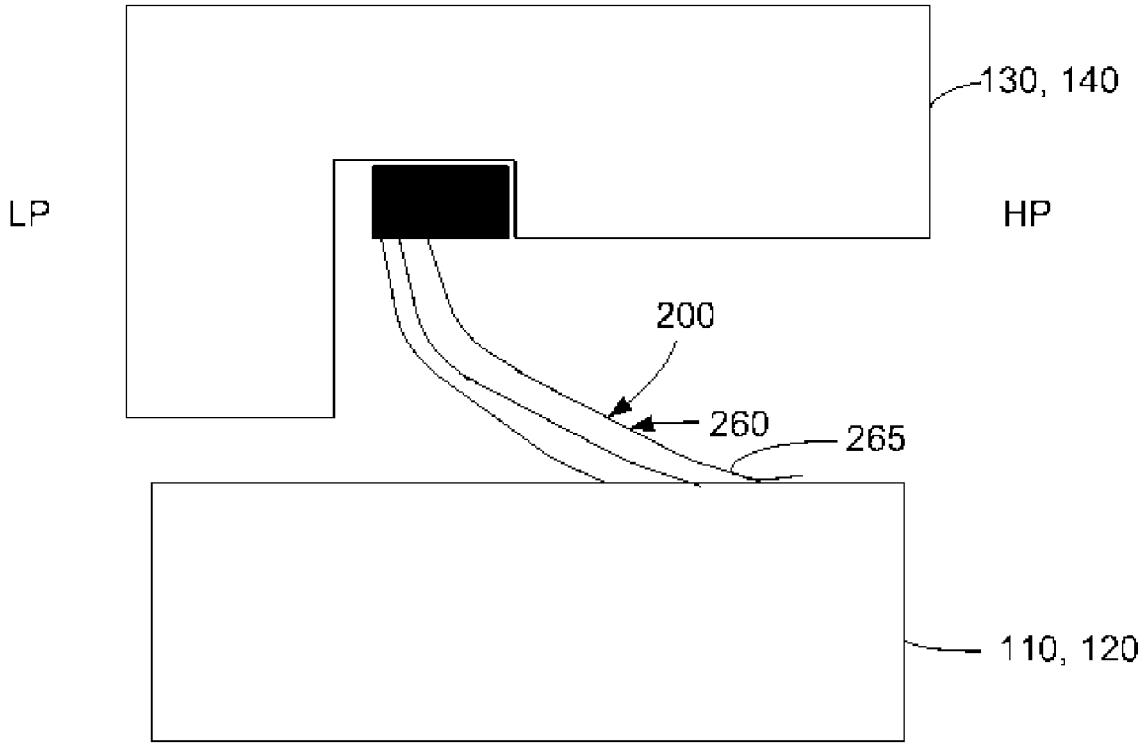
FIG. 6 is a further alternative embodiment of the exterior seal.

FIGS. 4-6 show the use of an exterior seal 200. The exterior seal 200 may be positioned between the ends of the CMC vanes 110, 120 and the inner diameter band 130 and the outer diameter band 140. The exterior seal 200 may be welded to the bands 130, 140.

The exterior seal 200 may take a number of different embodiments. FIG. 4 shows a crimped cloth seal 210. The crimped cloth seal 210 may include a porous cloth seal, a vertical portion of the cloth seal 220 and a horizontal portion of the cloth seal 230. (The terms "vertical" and "horizontal" are used as terms or reference as opposed to an actual orientation. A single cloth or multiple cloths also may be used.) The cloth 220, 230 may be made out of nickel-based, cobalt-based, or iron-based high temperature alloys or other types of materials with high temperature capability. For example, a Haynes 188 or L605 material may be used. The cloth 220, 230 may or may not have a shim 240 wrapped inside the cloth. The shim 240 may have slits therein. The slits may be positioned at regular intervals, for example, at about every quarter inch (about 6.35 millimeters) or so. The shims 240 also may be staggered. For example, there may be multiple shims 240 that are slit and are positioned so that the slits do not overlap. As is shown, the shim 240 may cover the cloth 220, 230. The shim 240 may be made out of nickel, cobalt, or iron-based high temperature alloys or similar types of materials with good wear resistance and oxidation behavior. The metallic shim 240 may be crimped onto the cloth 220, 230. The metallic cloth 220, 230 provides the wear surface while the shim 240 provides the sealing function FIG. 5 shows a further embodiment of the exterior seal 200, a sandwich cloth seal 250. In this embodiment, the metallic cloth 220, 230 surrounds the shim 240 in full or in part. FIG. 6 shows a further embodiment of the external seal 200, a metallic foil seal 260. Instead of using the shims 240 and the metallic cloth 220, 230, a metallic foil 265 is simply welded to the metallic bands 130, 140 and folded into position. The metallic foil 265 may be made out of metallic shims 240 entirely. Other configurations may be used herein.

Figure 7:
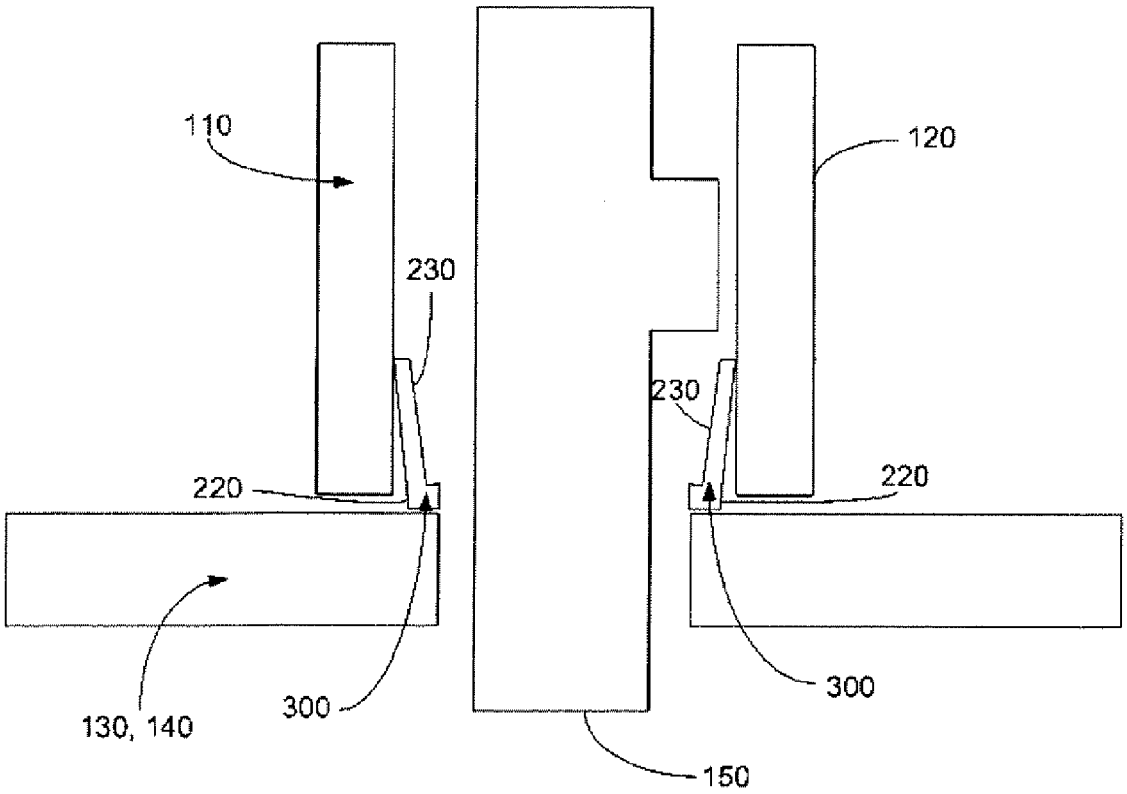
FIG. 7 is a cross-sectional view of an internal seal as is described herein.

FIG. 7 shows a further embodiment, an interior seal 300. The interior seal 300 is similar to the exterior seal 200 and is also attached to the bands 130, 140. The same configurations, however, may be used herein. Specifically, the use of a crimped cloth seal 210, the sandwich cloth seal 250, or the metallic foil seal 260 each may be used herein. Other configurations may be used herein.

Figure 8:
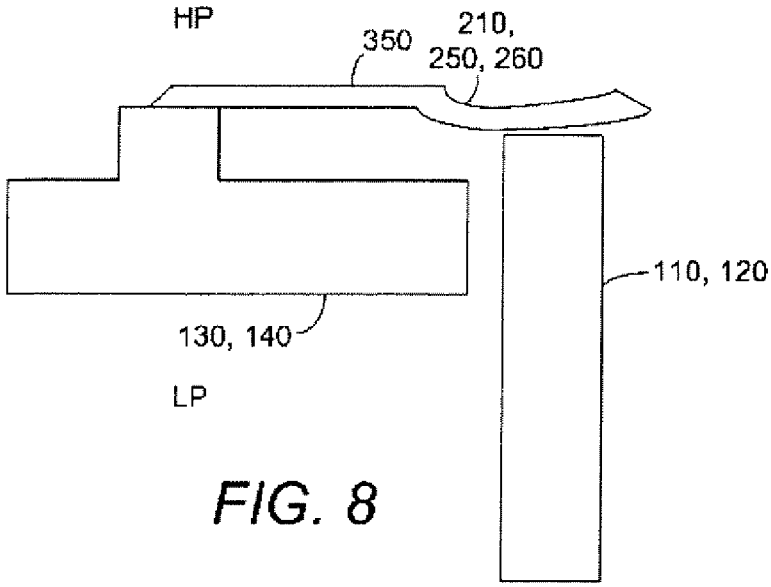
FIG. 8 is a cross-sectional view of a horizontal seal as is described herein.

FIG. 8 shows a further embodiment, a horizontal seal 350. The horizontal seal 350 is similar to the exterior seal 200 in that the seal is welded to the bands 130, 140. The horizontal seal 350, however, extends in a largely horizontal direction from the bands 130, 140 to the vanes 110, 120. As described above, the horizontal seal 350 may come in many variations including the crimped cloth seal 210, the sandwich cloth seal 250, and the metallic foil 260. Other configurations may be used herein.

In use, the seals 200, 300, 350 may be installed at the interface of the bands 130, 140 and the vanes 110, 120. Because the seals 200, 300, 350 are substantially compliant, the seals 200, 300, 350 can accommodate some dimensional variations in the vanes 110, 120. The compliant nature of the seals 200, 300, 350 also results in better seal effectiveness. The cooling air pressure generally pushes the seals 200, 300, 350 against the vanes 110, 120. The seals 200, 300, 350 thus perform better at high differential pressures. The seals 200, 300, 350 generally rest on the vanes 110, 120. As a result, the seals 200, 300, 350 exert minimum force on the vanes 110, 120.

An alternative design would include only the use of the shims 240 or the use of the foil 260 without the metallic cloth 220, 230. This design may not require active cooling. An alternate seal design would include coating the seals, either shims 240 or cloths 220, 230 or both, with thermal barrier coatings or similar coating for protection against high temperature and for increased life. The seals, shims or cloth or both, also may be coated with a wear or oxidation resistant coatings as well.

It should be apparent that the foregoing only relates to the preferred embodiments of the present application and that numerous changes and modifications may be made herein by one of ordinary skill in the art without departing from the general spirit and scope of the invention as defined by the following claims and the equivalents thereof.

What is claimed is:

1. A ceramic matrix composite nozzle assembly, comprising:

a ceramic matrix composite vane;

a metallic band positioned adjacent to the ceramic matrix composite vane; and an interior metallic seal positioned between an interior surface of the ceramic matrix composite vane and a surface of the metallic band, the interior metallic seal directly contacting the ceramic matrix composite vane and the metallic seal being attached to the metallic band.

2. The ceramic matrix composite nozzle assembly of claim 1, wherein the interior metallic seal comprises a plurality of shims.

3. The ceramic matrix composite nozzle assembly of claim 1, wherein the interior metallic seal comprises a cloth and a crimped metal shim.

4. The ceramic matrix composite nozzle assembly of claim 1, wherein the interior metallic seal comprises a shim and a metal cloth sandwich.

5. The ceramic matrix composite nozzle assembly of claim 1, wherein the interior metallic seal comprises a metallic foil.

6. The ceramic matrix composite nozzle assembly of claim 1, wherein the interior metallic seal comprises a compliant material.

7. The ceramic matrix composite nozzle assembly of claim 1, wherein the metallic band comprises one of an inner diameter band and an outer diameter band and wherein the interior metallic seal is attached to the one of the inner diameter band and the outer diameter band.

8. A ceramic matrix composite nozzle assembly, comprising:

a ceramic matrix composite vane;

a metallic band positioned about the ceramic matrix composite vane; and a horizontal metallic seal extending laterally from the metallic band to an end face of the ceramic matrix composite vane, the horizontal metallic seal being attached to the metallic band and the horizontal metallic seal resting against the end face of the ceramic matrix composite vane.

9. The ceramic matrix composite nozzle assembly of claim 8, wherein the horizontal metallic seal comprises a cloth and a crimped metal shim.

10. The ceramic matrix composite nozzle assembly of claim 8, wherein the horizontal metallic seal comprises a shim and a metal cloth sandwich.

11. The ceramic matrix composite nozzle assembly of claim 8, wherein the horizontal metallic seal comprises a metallic foil.

12. The ceramic matrix composite nozzle assembly of claim 8, wherein the horizontal metallic seal comprises a compliant material.

13. The ceramic matrix composite nozzle assembly of claim 8, wherein the metallic band comprises one of an inner diameter band and an outer diameter band and wherein the horizontal metallic seal is attached to the one of the inner diameter band and the outer diameter band.

* * * * *